US005756177A

United States Patent [19]

Cheong

[11] Patent Number: 5,756,177

[45] Date of Patent: May 26, 1998

[54] TOWEL EASY TO BE WOUND FIXED AROUND THE BODY

[76] Inventor: Sungkie Cheong, Hyondae Mujigae Apt. 108-1405, 530-5, Juley 3-dong, Sasang-ku, Pusan, Rep. of Korea

[21] Appl. No.: 710,810

[22] Filed: Sep. 23, 1996

[30] Foreign Application Priority Data

Nov. 29, 1995 [KR] Rep. of Korea ..... 95-37968

[51] Int. Cl.[6] ..... A41D 7/00; A47K 10/02

[52] U.S. Cl. ..... 428/52; 2/69; 428/99; 428/102

[58] Field of Search ..... 428/52, 100, 99, 428/102; 2/47, 211, 219, 220, 69

[56] References Cited

U.S. PATENT DOCUMENTS

| | | | |
|---|---|---|---|
| 2,313,399 | 3/1943 | Smink | 2/211 |
| 3,013,274 | 12/1961 | Dike | 428/52 X |
| 3,079,611 | 3/1963 | Boryszewski | 428/52 X |
| 3,166,112 | 1/1965 | Fisher | 428/52 X |
| 5,328,400 | 7/1994 | Bass | 446/98 |

*Primary Examiner*—Henry F. Epstein
*Attorney, Agent, or Firm*—Notaro & Michalos P.C.

[57] ABSTRACT

A towel for securely wrapping about the body of wearer is adjustably fastened using a fastener connected at one side edge of the towel which fastener can be selectively held in a corresponding opening or loop at the opposite side edge of the towel. Another embodiment in which a pair of cotton ties are used to adjustably fasten the towel is also provided.

4 Claims, 5 Drawing Sheets

TOWEL EASY TO BE WOUND FIXED AROUND THE BODY

FIELD OF THE INVENTION

The present invention relates to a towel which is easily wrapped about the body of a wearer and held in place by a fastener.

Figure 1:
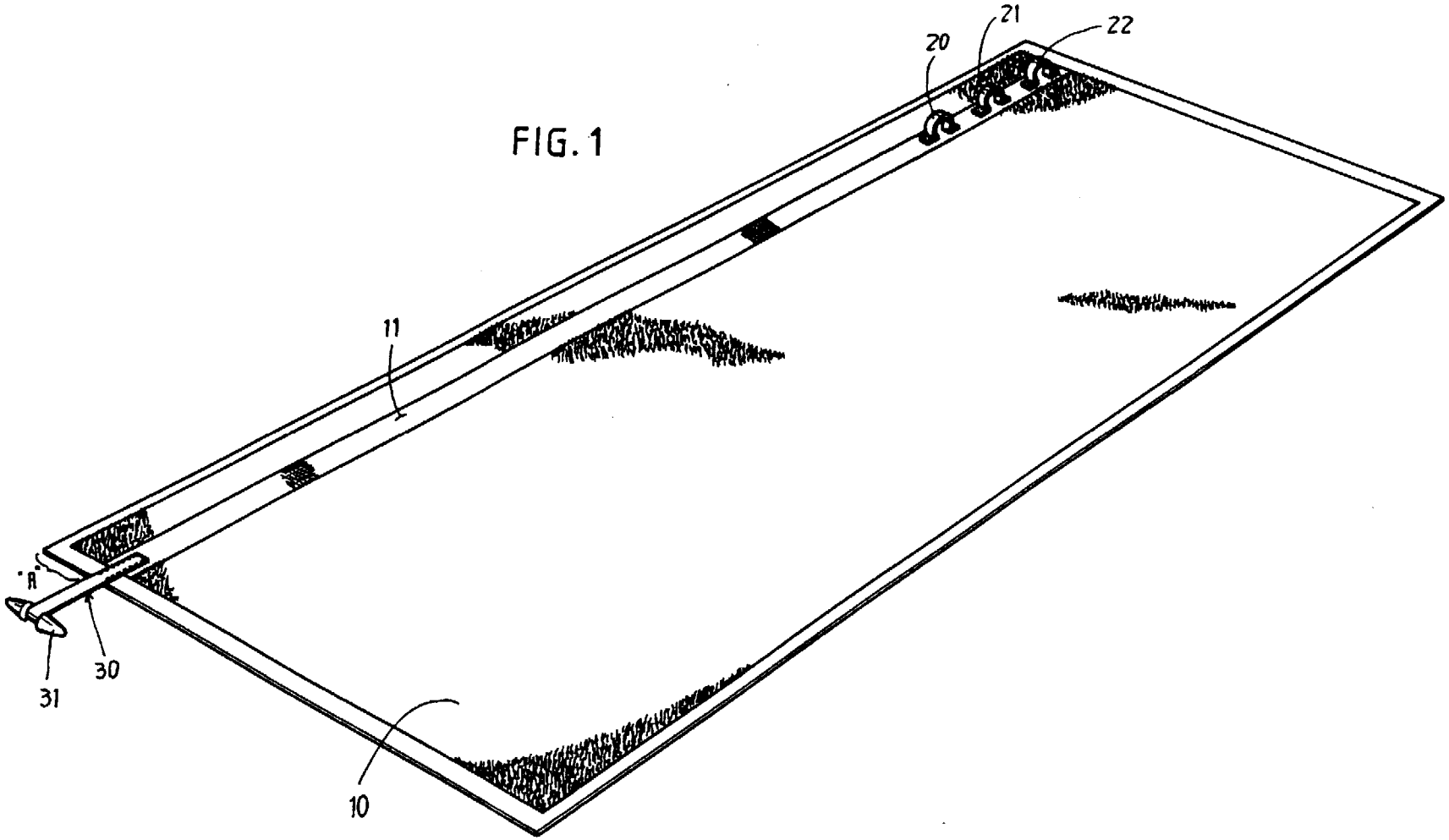
FIG. 1 is a perspective view of the present invention.

The reference numerals used in the drawings correspond to the following elements:

10. Towel 11. Cotton band

20, 21, 22, 80, 81, 82. Cotton loop

30. Cotton string 31. Fastener

40, 41, 42, 43. Cut-open hole

50, 51, 52. Rivet ring 60, 70. Cotton string

DETAILED DESCRIPTION OF THE INVENTION

The usual towel is 92 cm in width and 45 cm in length. Unless it is manufactured longer to order, it is very difficult to wind it around one's waist.

When one moves for a while in a sauna, in a bathhouse or in a dressing room, private parts are covered by taking hold of a towel in one hand or taking hold of both ends thereof which touch each other when it is bound about one's body. In this case, one hand can not be used, and so it is very inconvenient. At the same time, it also mars a good appearance.

Thus, the present invention is contrived to provide a towel which can be fixed without using the hand when it is bound about one's waist.

It will now be described in detail according to the drawing attached hereto.

In the present invention characterized by that a cotton band (11) is sewn along the length of a towel (10), a cotton string (30) is sewn up to the left side of the cotton band (11), a fastener (31), both ends of which are tapered is fixed to the end of the cotton string (30), several cotton loops (20) (21) (22) are sewn attached at regular intervals to the right side of the cotton band (11) and when the towel (10) is wound around one's waist, it is easily fixed by putting the fastener (31) in one of those cotton loops (20) (21) (22) according to the circumference of the waist, the fastener (31) is kept fixed in the cotton loop by the elasticity of the human body and by the weight of the towel and it is not easily taken off even when one moves the body unusually, if, as stated above, the cotton band is sewn along the length of the towel (10), the fastener (31) and the cotton loops (20) (21) (22) are attached to the left and right of the cotton band and the fastener (31) is put in a cotton loop situated suitably to the circumference of the waist when the towel is bound thereabout.

Figure 5:
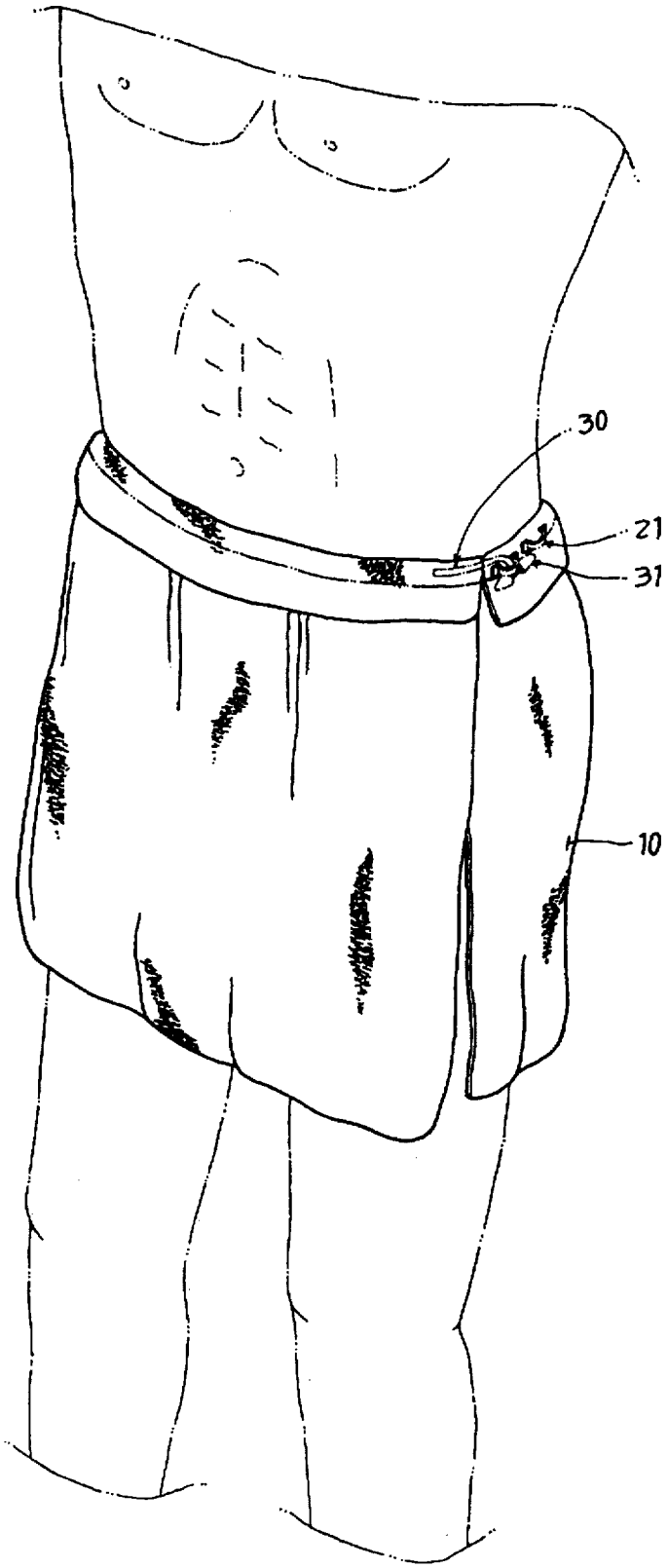
FIG. 5 is a reference view showing that the present invention is in use.

This is expressed as illustrated in FIG. 5. When the fastener is fixed in the cotton loop, the fastener and the cotton loop can be covered up if the "A" part of the cotton band (11) is folded down.

Therefore, appearance in use is beautiful, and the wearer's hands are free since the towel is fixed well around one's waist.

The fastener (31) can be covered with a cloth. The material of the fastener (31) can be wood or plastic.

Instead of the fastener (31), a general button is usable. It can be different as needed.

Figure 2:
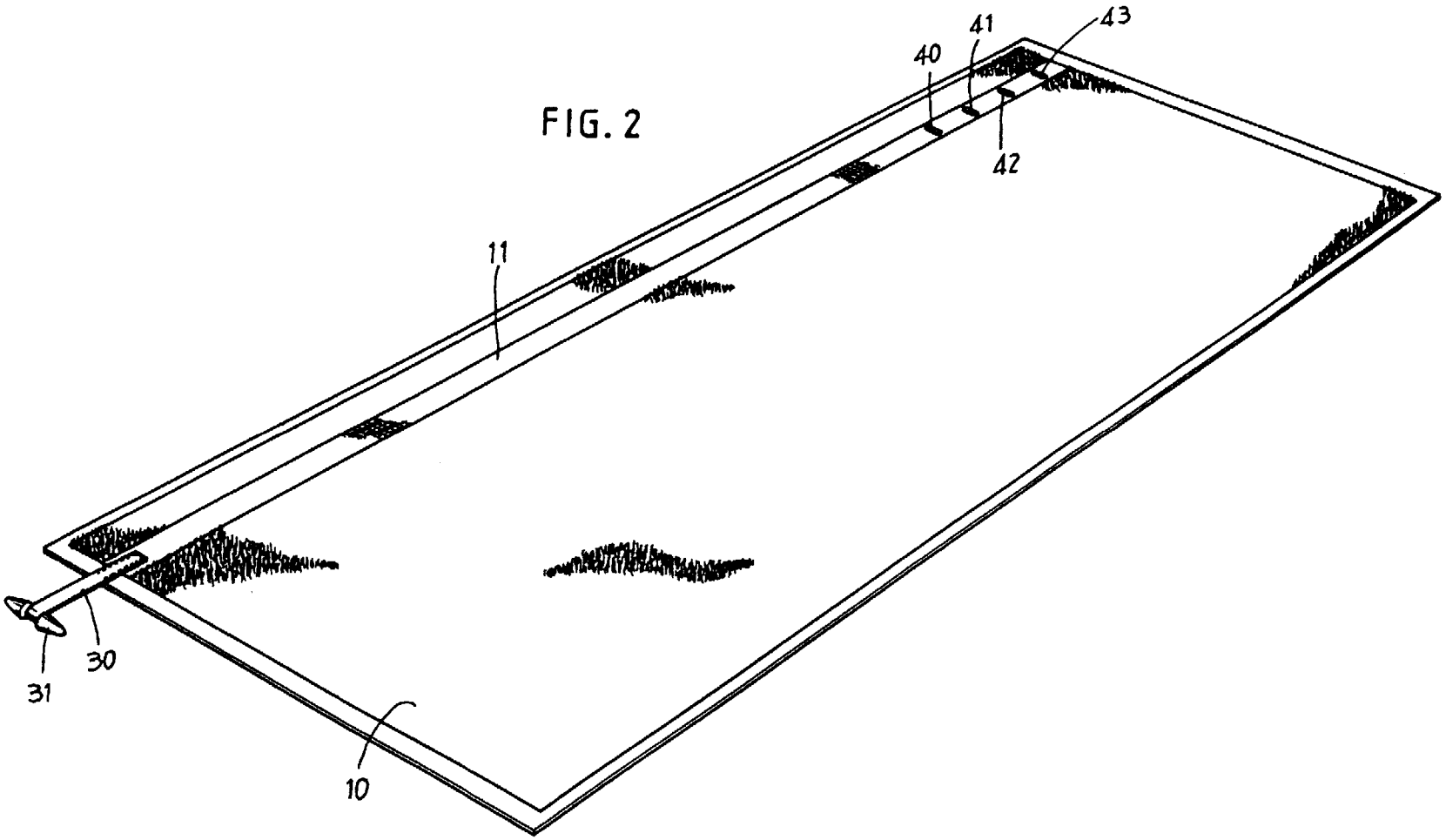
FIGS. 2, 3 and 4 are perspective views showing applied examples of the present invention.
Figure 3:
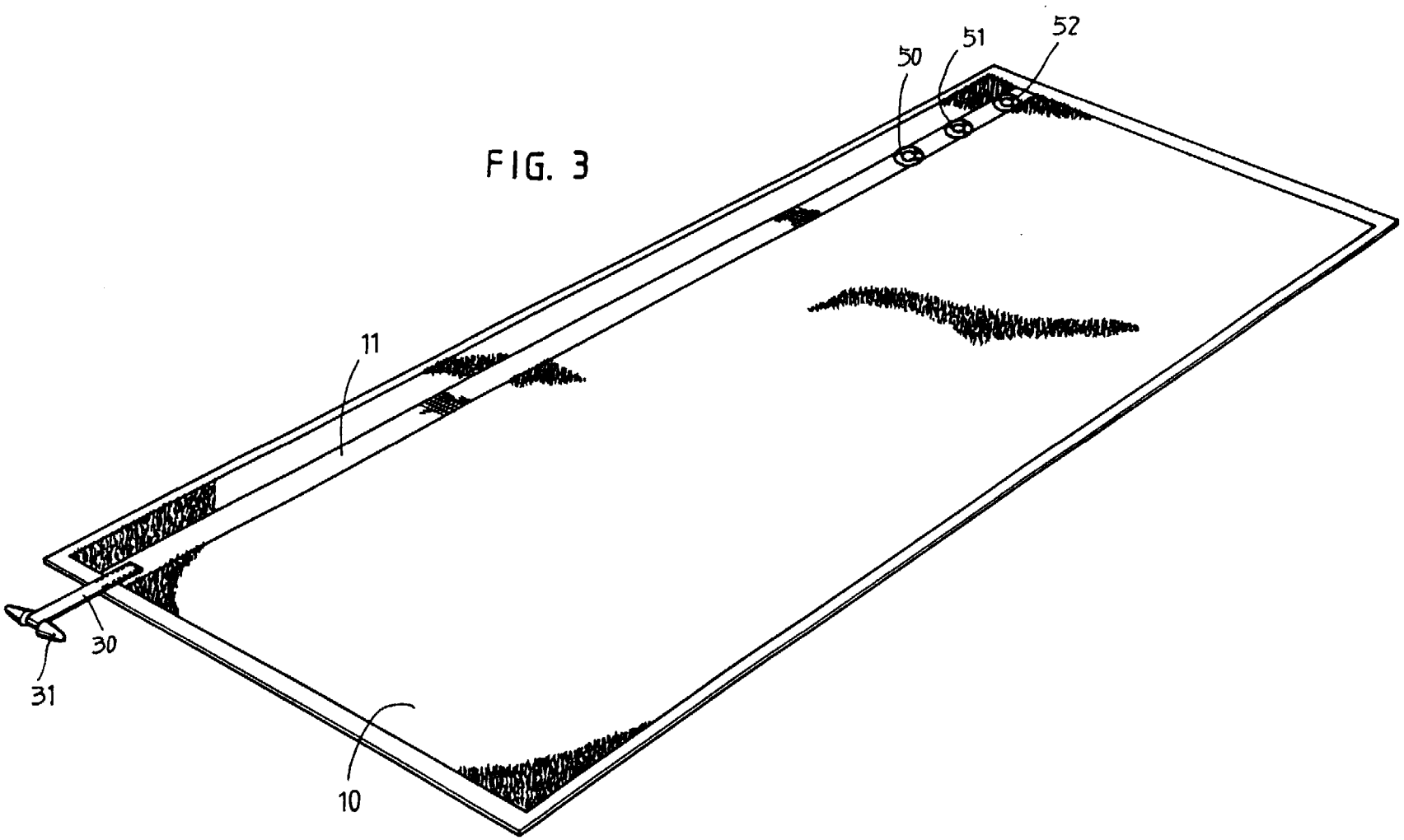
Figure 4:
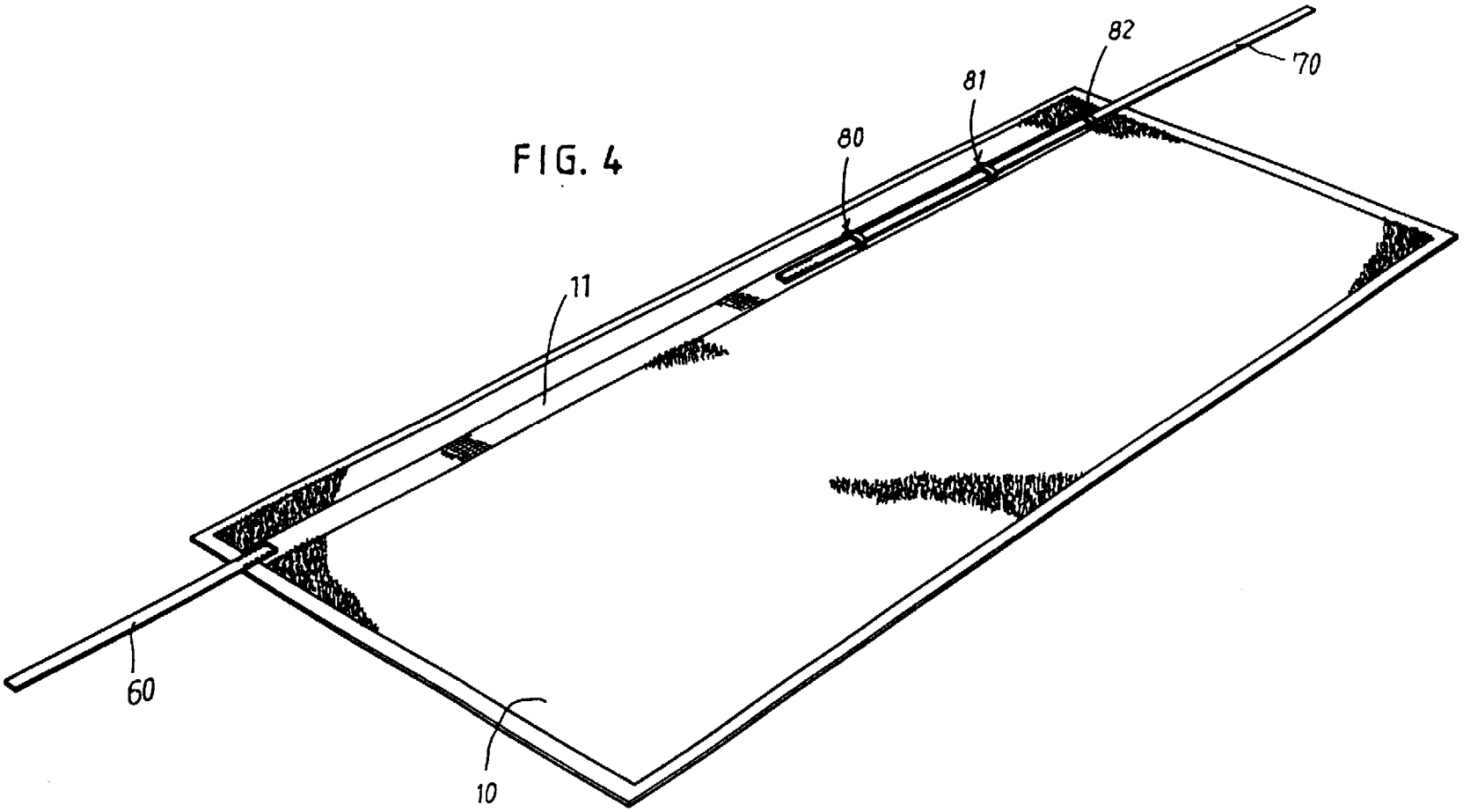

FIGS. 2, 3 and 4 illustrate applied examples of the present invention. These figures will be described in numerical order.

Referring to FIG. 2, it is similar to the basic pattern of FIG. 1 except that instead of the cotton loops (20) (21) (22), several cut-open holes (40) (41) (42) (43) are formed in the cotton band (11). Effectiveness of use is the same as the basic pattern of FIG. 1.

As to FIG. 3, it is also similar to the basic pattern of FIG. 1 Instead of the cotton loops (20) (21) (22) or the cut-open holes (40) (41) (42) (43), several rivet rings (50) (51) (52) are formed in the cotton band (11). Effectiveness of use is also the same as the basic pattern of FIGS. 1 and 2.

In FIG. 4, cotton strings (60) (70) are sewn to the left and right of the cotton band (11). The left cotton string (60) is attached to the left end of the cotton band (11) and the right cotton string (70) is attached near to the central part of the cotton band (11). To the place where the right cotton string (70) is situated several cotton loops (80) (81) (82) are attached, and the cotton string (70) is made adjustable by putting it thereinto or pulling it out therefrom.

This is a method in which the two cotton strings (60) (70) are tied up to each other. Effectiveness of fixing the towel (10) is similar to the aforesaid three patterns. However, it has the merit of being used flexibly by all persons from children to men and women.

The present utility as heretofore described is characterized by that a small-sized towel can be easily wound and fixed around one's waist. Thus, it not only serves the convenience of users but also increases utility value.

What is claimed is:

1. A towel easily wrapped and fixed about a body of a wearer, the towel comprising:

a cotton band sewn lengthwise to a first side of the towel between a left side edge of the towel and a right side edge of the towel;

a cotton string, at least a portion of which is stitched to the cotton band at one of the left and right side edges of the towel, a remainder portion of the cotton string extending past the adjacent side edge of the towel;

a fastener fixed to the remainder portion of the cotton string, the fastener having a pair of ends each of which tapers away from a fastener middle; and a plurality of cotton loops sewn to the cotton band adjacent the opposite one of the left and right side edges where the cotton string is stitched, the loops spaced apart along the cotton band at regular intervals and sized such that the fastener may be inserted through and held by any one of the plurality of loops, whereby the towel may be wrapped about the body of the wearer and the towel adjustably fastened about the body by placing the fastener through one of the loops.

2. A towel easily wrapped and fixed about a body of a wearer, the towel comprising:

a cotton band sewn lengthwise to a first side of the towel between a left side edge of the towel and a right side edge of the towel;

a cotton string, at least a portion of which is stitched to the cotton band at one of the left and right side edges of the towel, a remainder portion of the cotton string extending past the adjacent side edge of the towel;

a fastener fixed to the remainder portion of the cotton string, the fastener having a pair of ends each of which tapers away from a fastener middle; and a plurality of cut-open holes through the cotton band adjacent the opposite one of the left and right side edges where the cotton string is stitched, the cut-open holes spaced apart along the cotton band at regular intervals and sized such that the fastener may be inserted through any one of the plurality of cut-open holes and held by the cotton band, whereby the towel may be wrapped about the body of the wearer and the towel adjustably fastened about the body by placing the fastener through one of the cut-open holes.

3. A towel easily wrapped and fixed about a body of a wearer, the towel comprising:

a cotton band sewn lengthwise to a first side of the towel between a left side edge of the towel and a right side edge of the towel;

a cotton string, at least a portion of which is stitched to the cotton band at one of the left and right side edges of the towel, a remainder portion of the cotton string extending past the adjacent side edge of the towel;

a fastener fixed to the remainder portion of the cotton string, the fastener having a pair of ends each of which tapers away from a fastener middle; and a plurality of rivet rings in the cotton band adjacent the opposite one of the left and right side edges where the cotton string is stitched, the rivet rings spaced apart along the cotton band at regular intervals and sized such that the fastener may be inserted through any one of the plurality of rivet rings and held, whereby the towel may be wrapped about the body of the wearer and the towel adjustably fastened about the body by placing the fastener through one of the rivet rings.

4. A towel easily wrapped and fixed about a body of a wearer, the towel comprising:

a cotton band sewn lengthwise to a first side of the towel between a left side edge of the towel and a right side edge of the towel;

a first cotton string, at least a portion of which is stitched to the cotton band adjacent one of the left and right side edges of the towel, a remainder portion of the first cotton string extending past the adjacent side edge of the towel;

a second cotton string stitched at one second string end to the cotton band proximate a center of the towel between the left and right side edges, the other second string end extending past the opposite one of the left and right side edges from the first cotton string;

a plurality of spaced apart loops sewn to the cotton band such that the second cotton string is placed through and slidable within each of the plurality of spaced apart loops, whereby the towel may be wrapped about the body of the wearer and the towel adjustably fastened about the body by pulling the second cotton string through the plurality of spaced apart loops and tying the second cottong string to the first cotton string.

* * * * *